US005957733A

United States Patent [19]

Mello et al.

[11] Patent Number: 5,957,733

[45] Date of Patent: Sep. 28, 1999

[54] ELECTRICAL TERMINAL CONNECTOR

[75] Inventors: Keith F. Mello; Raymond G. Lavoie, both of Manchester; Christopher G. Chadbourne, Nashua; William J. Lasko; Roger H. Hanks, both of Littleton, all of N.H.

[73] Assignee: Framatome Connectors USA, Inc., Fairfield, Conn.

[21] Appl. No.: 08/882,095

[22] Filed: Jun. 25, 1997

[51] Int. Cl.[6] ..... H01R 4/36

[52] U.S. Cl. ..... 439/814; 439/810

[58] Field of Search ..... 439/810–814

[56] References Cited

U.S. PATENT DOCUMENTS

| | | | |
|---|---|---|---|
| 2,920,305 | 1/1960 | Gibson et al. | 439/814 |
| 3,374,456 | 3/1968 | Evans | 439/814 |
| 3,727,171 | 4/1973 | Coles et al. | 439/810 |
| 4,214,806 | 7/1980 | Kraft | 439/814 |
| 5,030,131 | 7/1991 | Boehm | 439/387 |
| 5,117,211 | 5/1992 | Morgan et al. | 439/810 |
| 5,197,907 | 3/1993 | Hurtgen | 439/810 |
| 5,269,710 | 12/1993 | Donnerstag | 439/810 |

*Primary Examiner*—Hien Vu
*Attorney, Agent, or Firm*—Perman & Green, LLP

[57] ABSTRACT

An electrical terminal connector comprising a connector body and a set screw. The connector body has a block section with a conductor receiving passageway. The set screw is connected to the block section to intersect the conductor receiving passageway. The block section further defines a porthole extending therethrough. The porthole intersects the conductor receiving passageway forming a lower recess therein. When a conductor is inserted into the conductor receiving passageway, the recess receives a portion of the conductor which is clamped down upon by the set screw.

13 Claims, 3 Drawing Sheets

ELECTRICAL TERMINAL CONNECTOR

BACKGROUND OF THE INVENTION

1. Field of the Invention

The present invention relates to electrical connectors, and more specifically to solderless electrical terminal connectors.

2. Prior Art

Solderless electrical terminal connectors are generally well known in the art. One example is found in U.S. Pat. No. 5,030,131 which shows an electrical terminal connector employing a set screw to secure a conductor.

SUMMARY OF THE INVENTION

In accordance with one embodiment of the present invention, an electrical terminal connector is provided, comprising a connector body and a set-screw. The connector body has a block section with a conductor receiving passageway. The set screw is connected to the block section to intersect the conductor receiving passageway. The block section further defines a porthole extending therethrough. The porthole intersects the conductor receiving passageway forming a lower recess therein. The recess receives a portion of a conductor inserted into the conductor receiving passageway when the conductor is clamped down upon by the set screw.

In accordance with another embodiment of the present invention, an electrical terminal connector is provided having a connector body and a set screw. The connector body has a generally block shaped section. The set screw is threadably connected to the block shaped section. The block shaped section is an extrusion having a porthole extending therethrough. The porthole is generally aligned to intersect a longitudinal axis of the set screw.

In accordance with one method of the present invention, a method of manufacturing an electrical terminal connector is provided, comprising the steps of extruding a connector body and connecting a set screw to the connector body. Upon extrusion, the connector body has a block section and an elongated cantilevered support. The block section has a porthole extending therethrough. The set screw is connected to the connector body for movement into the porthole.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
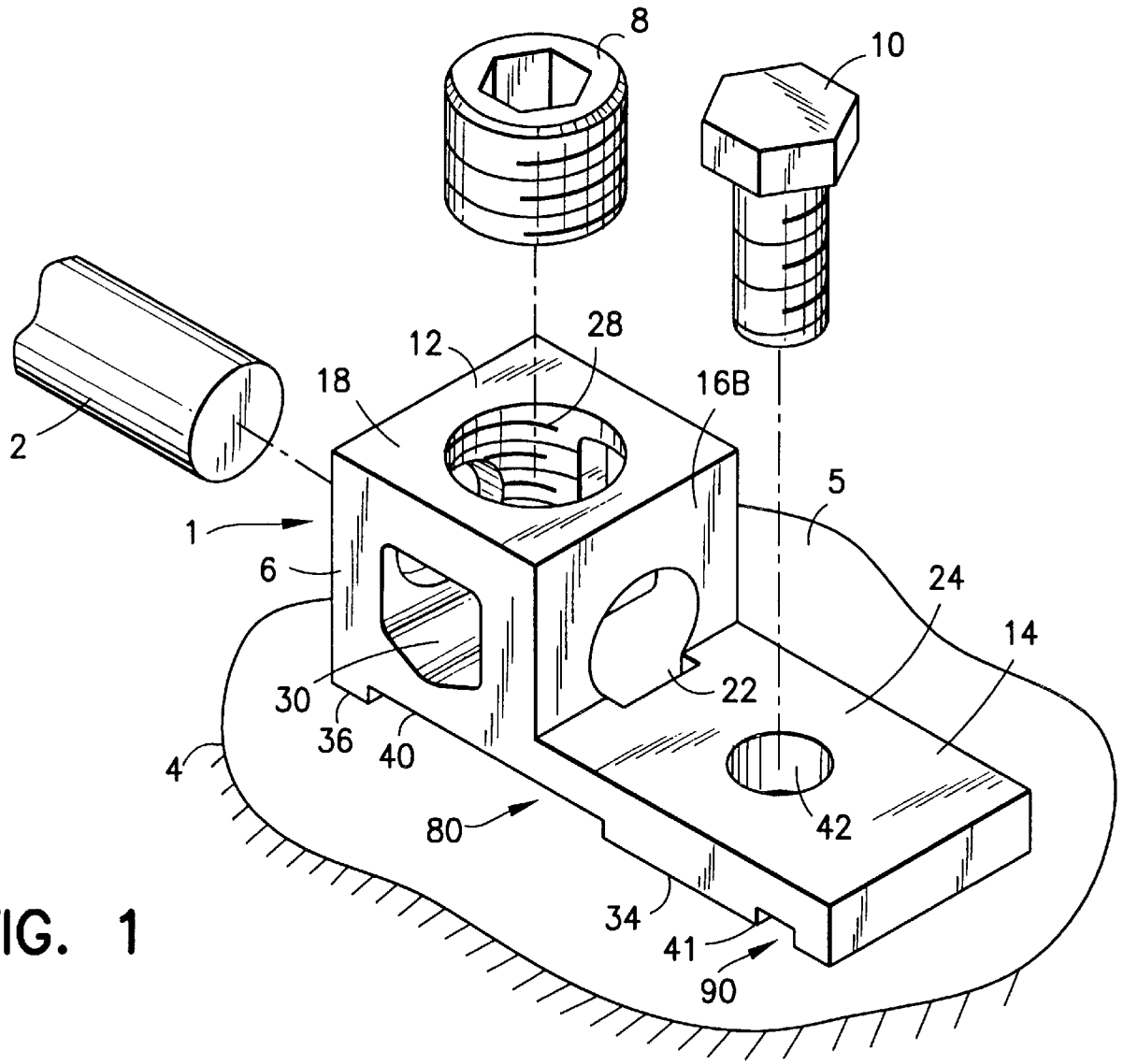
FIG. 1 shows an exploded perspective view of an electrical terminal connector incorporating features of the present invention.

Referring to FIG. 1, there is shown an exploded perspective view of an electrical terminal connector 1 incorporating features of the present invention. Although the present invention will be described with reference to the embodiment shown in the drawings, it should be understood that the present invention can be embodied in various different types of electrical terminal connectors. In addition, any suitable size, shape or type of elements or materials could be used.

As shown in FIG. 1, the electrical terminal connector 1 electrically connects a conductor 2 to an electrical bus 4. The terminal connector 1 is mechanically and electrically connected to a mating surface 5 of the electrical bus 4. The conductor 2 is mechanically and electrically connected to the terminal connector 1. Hence, the conductor 2 is electrically and mechanically connected to the bus 4.

The terminal connector 1 comprises a body 6, a set screw 8 and a mounting screw or bolt 10. The set screw 8 and mounting bolt 10 are movably connected to the body 6. The connector body 6 is preferably made from an extrudable metal, such as aluminum. The connector body 6 has a generally block shaped section 12 and an elongated support 14 cantilevered therefrom. The elongated support 14 cantilevers from a longitudinal side 16B of the block section 12.

Figure 2:
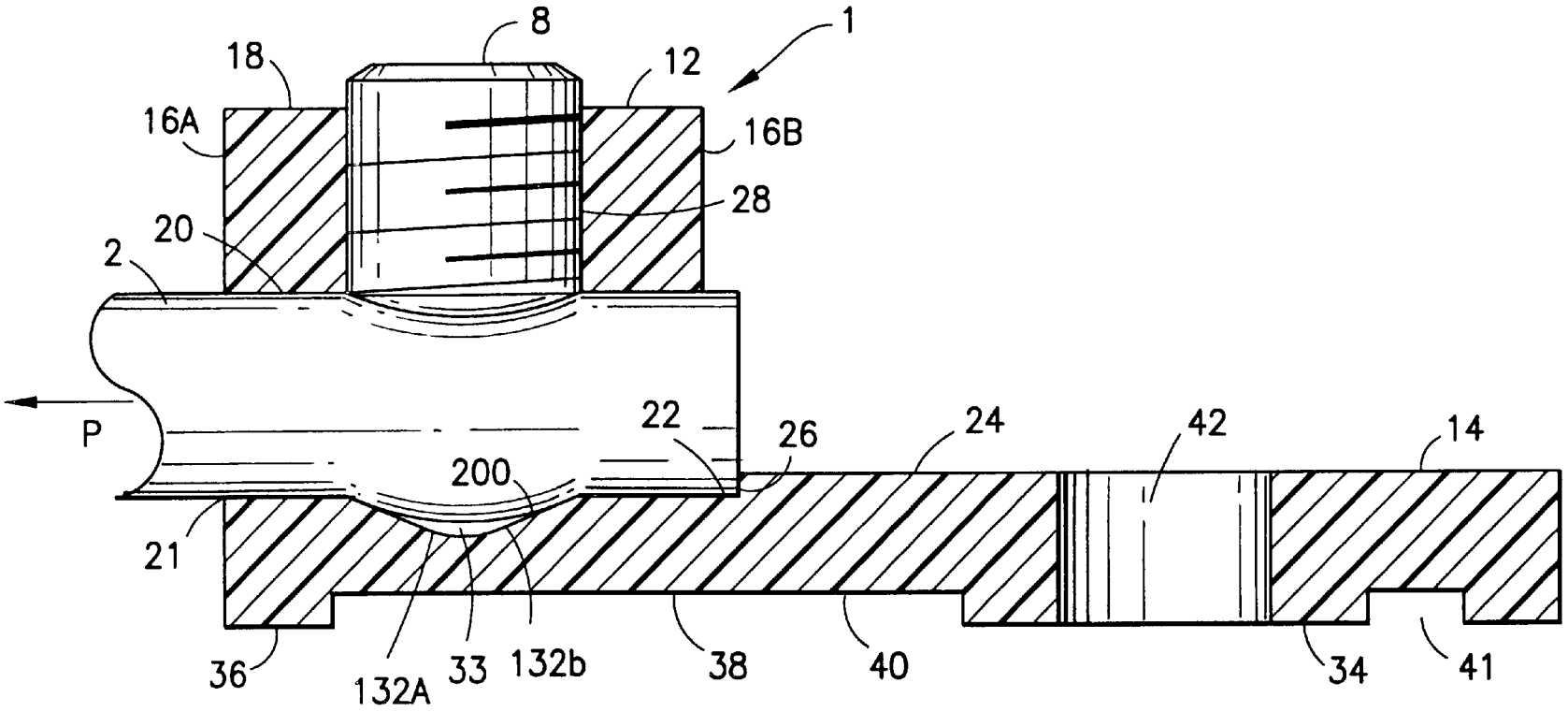
FIG. 2 shows a cross-sectional elevation view of the electrical terminal connector shown in FIG. 1.

Referring also to FIG. 2, the block section 12 has a conductor receiving passageway 20 extending therethrough. The conductor receiving passageway 20 has a circular cross-section sufficient to admit the conductor 2. The passageway 20 is aligned generally parallel to the longitudinal axis of the elongated support 14. The conductor receiving passageway 20 has an opening 21 on the longitudinal side 16A of the block section 12 opposite the elongated support 14. In the preferred embodiment, the passageway 20 penetrates through the block section 12, longitudinally extending into the elongated support 14, so that a channel 22 is formed in the upper surface 24 of the support 14 (see FIG. 1). The channel 22 ends in a general step surface or stop 26. In alternate embodiments, the passageway may terminate within the block section 12.

A threaded hole 28 for the set screw 8 extends into the block section 12 from its top 18. The threaded hole 28 intersects the conductor receiving passageway 20. This allows the set screw 8 to be threaded into the hole 28 to enter the conductor receiving passageway 20.

Figure 3:
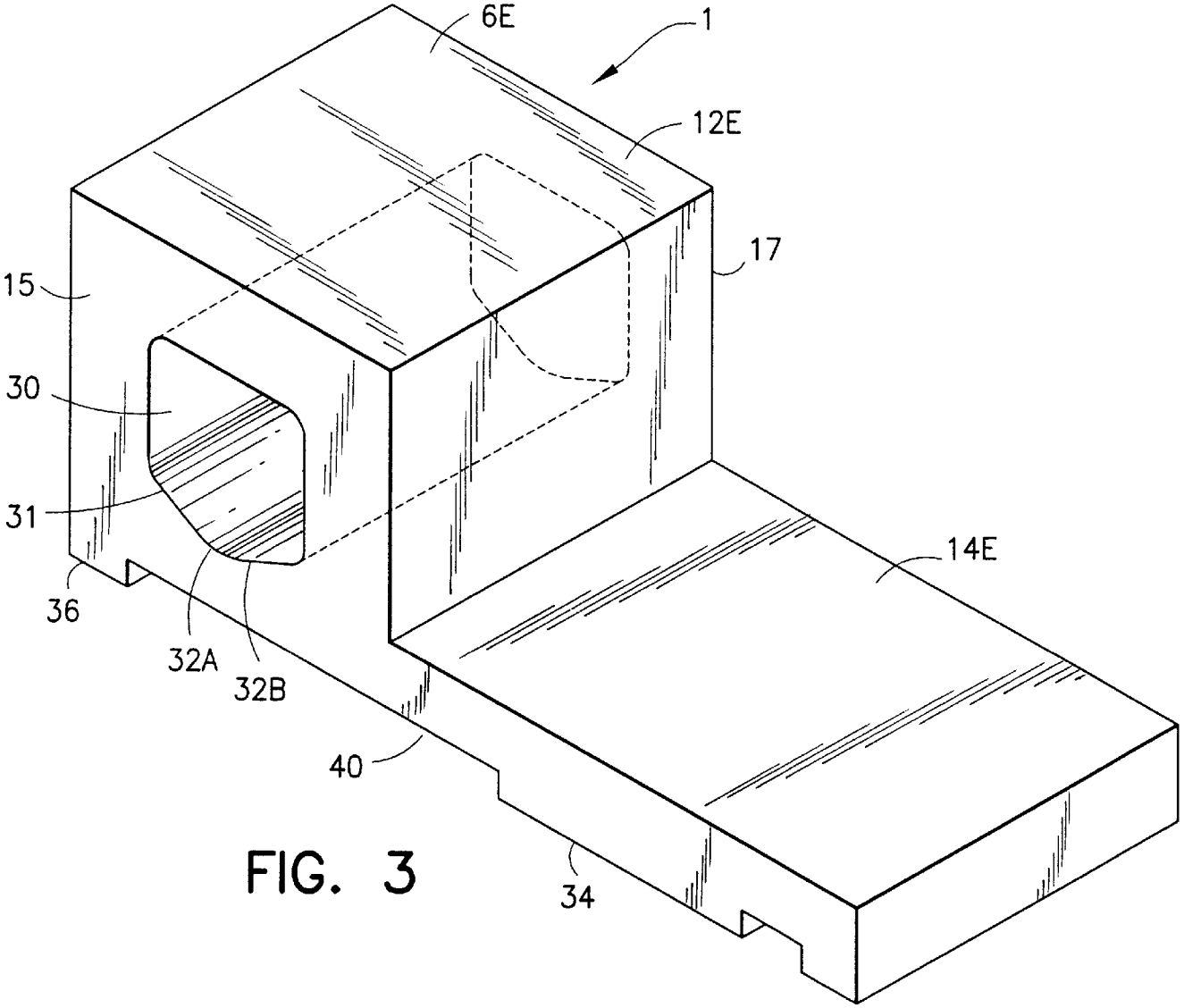
FIG. 3 shows a perspective view of an extruded workpiece for the electrical terminal connector of FIG. 1.

The block section 12 also comprises a channel or porthole 30. The porthole 30 extends through the block section 12, from its front 15 to its back 17 (see FIG. 3). The porthole 30 is aligned generally perpendicular to the conductor receiving passageway 20 (see FIG. 1). The bottom 31 of the porthole 30 is located below the conductor receiving passageway 20. The porthole 30 intersects the conductor receiving passageway 20, forming a lower recess 33 in the conductor receiving passageway 20. The recess 33 extends below the conductor receiving passageway 20. The recess is generally located below the threaded hole 28 in the block section 12. In the preferred embodiment, the porthole 30 has a polygonal cross section as shown in FIG. 3. The bottom 31 of the porthole 30 has two sides 32A, 32B angled towards each other and intersecting at an obtuse angle. Portions 132A, 132B corresponding to the two sides 32A, 32B form the recess 33 (see FIG. 2). In alternate embodiments, the porthole may have any suitable shape, such as round or triangular, to form a recess in the conductor receiving passageway 20. In another alternate embodiment, the porthole could be formed as an open sided channel.

Still referring to FIG. 2, the elongated support 14 has a first seating area 34 thereon. The block section 12 has a second seating area 36. The second seating area 36 is generally co-planar with the first seating area 34 on the elongated support 14. The lower surface 38 of the block section 12 is otherwise inwardly offset from the seating area 36. The lower surface 38 uniformly extends along the elongated support 14 to the first seating area 34. Thus, a recess 40 is formed between the first seating area 34 on the support 14 and the second seating area 36 on the block section 12. In the preferred embodiment, the elongated support 14 has a mounting hole 42 extending therethrough. The mounting hole 42 penetrates through the first seating area 34. In alternate embodiments, additional mounting holes may be provided in the elongated support as required. In the preferred embodiment, the first seating area 34 has a groove 41 formed therein. In alternate embodiments, the seating surface on the elongated support may have several grooves formed therein.

The body 6 of the electrical terminal connector 1 is preferably formed by extrusion. Referring also to FIG. 3, the extruded work piece 6E, which is extruded and later machined to form the body 6, is shown. The workpiece 6E comprises the block section 12E with the elongated support 14E cantilevered therefrom. During extrusion, the block section 12E has the porthole 30 formed therein. In the preferred embodiment, the extruded work piece 6E has the recess 40, between the first seating area 34 and the second seating area 36, formed during the extrusion process. In an alternate embodiment, the recess in the lower surface of the work piece may be formed after extrusion by any suitable metal working process.

The extruded work piece 6E is worked further to render it into the connector body 6 shown in FIG. 2. The block section 12E is bored through to form the conductor receiving passageway 20. The hole 28 for the set screw 8 is drilled and threaded. The elongated support 14E of the workpiece 6E is drilled through to provide the mounting hole 42.

In order to make the electrical connection between the conductor 2 and the electrical bus 4, the electrical terminal connector 1 is connected to the bus 4 as shown in FIG. 1. The body 6 of the terminal connector 1 is mechanically connected to the bus 4 by inserting the mounting bolt 10 through the mounting hole 42 in the elongated support 14 and into a hole (not shown) in the bus 4. The first seating area 34 and the second seating area 36 seat against the mating surface 5 forming the electrical connection between terminal connector 1 and bus 4. Gaps 80, 90 are formed between the mating surface 5 of the bus 4, and the body 6 of the terminal connector 1 in way of the recess 40 and the groove 41 therein. The conductor 2 is inserted into the conductor receiving passageway 20 until stopped against the step surface 26 (see FIG. 2) . The set screw 8 is threaded into hole 28 in the block section 12 to clamp the conductor 2 to the body 6 of the terminal connector 1. The set screw 8 is threaded to press against the conductor 2 sufficiently to urge a portion 200 thereof into the lower recess 33 of the conductor receiving passageway 20. In an alternate embodiment, the connector body 6 may have a block section that has only the porthole 30 formed during the extrusion process and the threaded hole 28 for the set screw 8. In that event, the conductor 2 is connected to the terminal connector 1 by being inserted into the porthole 30. The set screw 8 is then threaded in the hole 28 to clamp the conductor 2 in the porthole 30 to the connector body 6. Clamping the conductor 2 to the electrical terminal connector 1 electrically and mechanically connects the conductor 2 to the connector 1.

The present invention provides an electrical terminal connector 1 capable of maintaining the connection with the conductor 2 against increased pull out forces on the conductor 2. This higher resistance to conductor pullout is the result of having the recess 33 in the conductor receiving passageway 20 located below the set screw 8. The sides 132A, 132B of the recess 33 co-act with the set screw 8 on the portion 200 of the conductor 2 clamped into the recess 33 to generate positive resistance to pullout. When pullout forces P are applied to the conductor 2, the portion 200 in the recess 33 abuts the side 132A of the recess 33, resulting in contact forces on the conductor 2 directly counter to the pullout forces P (see FIG. 2). These contact forces in combination with friction forces on the conductor 2, due to clamping pressure from the set screw 8, increase the pullout resistance of the terminal connector 1 of the present invention. In alternate embodiments, the porthole cross-section may have other suitable shapes to increase the number of sides, in the recess, co-acting with the set screw to generate direct pullout resistance.

The present invention provides an electrical terminal connector 1 with increased conductor pullout resistance at reduced cost in comparison to other terminal connectors. Extruding the connector body 6 with the porthole 30 formed therein reduces the quantity of material required for fabrication of the electrical terminal connector 1. By forming the porthole 30 at the same time the connector body 6 is extruded, the amount of material needed to fabricate the body 6 is less then if the porthole 30 were formed subsequent to extrusion of the connector body 6. An additional reduction in the material necessary to fabricate the connector body 6 is provided by also forming the recess 40 during extrusion of the body 6. The reduction in material used to fabricate the connector body 6 reduces the cost of the terminal connector 1. The described process also eliminates further metal working steps, such as drilling or boring operations, required to form the recess 33 in the conductor receiving passageway 20.

The electrical terminal connector 1 of the present invention also has increased conventional heat dissipation, thereby possibly reducing the operating temperature of the connector 1. An increase in convectional heat dissipation is provided by the recess 40 and groove 41 in the bottom of the electrical terminal connector 1. The recess 40 and groove 41 create gaps 80, 90 between the connector body 6 and mating surface 5 of the bus 4 (see FIG. 1). Hence, the net surface area of the connector 1 exposed to free air is increased with a corresponding increase in convectional heat dissipation.

It should be understood that the foregoing description is only illustrative of the invention. Various alternative and modifications can be devices by those skilled in the art without departing from the invention. Accordingly, the present invention is intended to embrace all such alternative, modifications and variances which fall within the scope of the appended claims.

What is claimed is:

1. An electrical terminal connector comprising:

a connector body with a block section having a conductor receiving passageway;

a set screw connected to the block section to intersect the conductor receiving passageway, wherein, the block section further defines a porthole extending therethrough, the porthole intersects the conductor receiving passageway forming a recess, therein which extends below the conductor receiving passageway and, when a conductor is inserted into the conductor receiving passageway, the recess receives a portion of the conductor which is clamped down upon by the set screw.

2. An electrical terminal connector as in claim 1, wherein the connector body has an elongated support cantilevered from the block section.

3. An electrical terminal connector as in claim 2, further comprising a first seating surface located on the block section and a second seating surface located on the elongated support, the second seating surface being generally aligned with the first seating surface.

4. An electrical terminal connector as in claim 3, wherein the block section has a lower surface inwardly offset from the first seating surface, the lower surface uniformly extending along the elongated support to the second seating surface so that a channel is formed between the first seating surface and the second seating surface.

5. An electrical terminal connector as in claim 3, wherein the second seating surface has at least one channel formed therein.

6. An electrical terminal connector as in claim 1, wherein the recess in the conductor receiving passageway is generally perpendicular to the conductor receiving passageway.

7. An electrical terminal connector as in claim 1, wherein the porthole has substantially flat sides.

8. An electrical terminal connector as in claim 1, wherein the porthole has a bottom comprising two sides angled toward each other and intersecting at an obtuse angle.

9. An electrical terminal connector as in claim 1, wherein the set screw penetrates into the porthole when the set screw is clamped down on the conductor inserted in the conductor receiving passageway.

10. An electrical terminal connector as in claim 2, wherein the conductor receiving passageway is aligned generally parallel to a longitudinal axis of the elongated support.

11. An electrical terminal connector as in claim 10, wherein a portion of the conductor receiving passageway extends partially into the elongated support, said portion of the conductor receiving passageway terminating in a stepped stop surface.

12. An electrical connector as in claim 1, wherein the porthole has a portion thereof located below the conductor receiving passageway.

13. An electrical connector as in claim 1, wherein the recess in the conductor receiving passageway is located substantially under the set screw, and wherein the set screw bends the conductor into the recess when the set screw is clamped down upon the conductor.

* * * * *